US005664641A

United States Patent [19]

Ritze

[11] Patent Number: 5,664,641

[45] Date of Patent: Sep. 9, 1997

[54] ROOF MAINTENANCE STAIR STEP APPARATUS

[76] Inventor: Donald E. Ritze, 10952 Glen Robin La., Orange, Calif. 92669

[21] Appl. No.: 611,904

[22] Filed: Mar. 6, 1996

[51] Int. Cl.[6] ..... E04G 3/12

[52] U.S. Cl. ..... 182/45; 248/237

[58] Field of Search ..... 182/45, 113, 132, 182/222, 151, 178; 52/182, 191, 183; 248/237

[56] References Cited

U.S. PATENT DOCUMENTS

| | | | |
|---|---|---|---|
| 262,508 | 8/1882 | Thomson . | |
| 718,602 | 1/1903 | Chase . | |
| 799,487 | 9/1905 | Neice . | |
| 1,520,414 | 12/1924 | Hamilton . | |
| 2,171,374 | 8/1939 | Ryan | 52/8 |
| 2,466,982 | 4/1949 | Eastwood | 52/8 |
| 2,593,683 | 4/1952 | Lyons | 182/178 |
| 3,343,316 | 9/1967 | McIntire | 52/183 X |
| 3,888,058 | 6/1975 | Avery | 52/191 |
| 4,842,229 | 6/1989 | Murray | 248/148 |
| 5,119,904 | 6/1992 | Dierolf | 182/230 |
| 5,249,397 | 10/1993 | Monaco | 52/126.1 |

FOREIGN PATENT DOCUMENTS

| | | | |
|---|---|---|---|
| 180713 | 1/1955 | Australia . | |
| 221270 | 10/1961 | Australia | 52/191 |
| 54481 | 5/1890 | Germany . | |

*Primary Examiner*—Alvin C. Chin-Shue

*Attorney, Agent, or Firm*—Gene Scott Patent Law & Venture Group

[57] ABSTRACT

A stair step assembly provides a safe means for mounting a peaked roof. Individual steps interlock with each other and with tiles of a tile roof so that the assembly cannot slide off the roof. Each step has a platform supported from below by a frame having a primary and secondary rest. The rests lie in contact with the roof and provide a foot constructed so that one portion of the foot is in contact with an vertical edge of a line of tiles to prevent the step from sliding.

1 Claim, 2 Drawing Sheets

ROOF MAINTENANCE STAIR STEP APPARATUS

BACKGROUND OF THE INVENTION

1. Field of the Invention

This invention relates generally to brackets and supports designed for use on pitched roofs or other inclined surfaces, and more particularly to a portable step system for use by roof installation and maintenance personnel.

2. Description of Related Art

Invention and use of roof platforms is known to the public, as they are frequently used to stage materials and personnel atop a roof. Chase, U.S. Pat. No. 718,602 and U.S. Pat. No. 681,649 discloses a roof-bracket which comprises three principal members. The bracket provides a base to rest upon the roof, a platform-support, and a brace, the three being slidably and pivotally connected in such manner that the platform-support can be made horizontal whatever the inclination or pitch of the roof. A means is provided to prevent movement of the platform-support and brace relative to each other and to the base when the parts have been adjusted. Neice, U.S. Pat. No. 799,487 discloses a bracket which provides simple construction and forms a convenient support for the use of carpenters and others in shingling or repairing roofs and that it may be adjusted for application to roofs of different pitch. The device may also be employed as a bracket or jack for the use of painters and other workmen. Hamilton, U.S. Pat. No. 1,520,414 discloses a knockdown ladder that can be quickly assembled and disassembled to produce a rigid construction. A clamping element is provided for the leg sections that retains the rungs in position. Murray U.S. Pat. No. 4,842,229 discloses a portable, adjustable roof platform for use by painters on inclined roof surfaces. The roof platform has two moving parts for quickly adjusting the platform to a horizontal position. The adjustable roof platform includes a horizontal base with vertical rod receiving female members. The base is made of a reinforced frame with an expanded metal platform. An upright wall is affixed to the metal platform to support paint buckets. At least one adjustable rod is slidable in the female member to adjust the horizontal base to the angle of pitch of the roof. A locking thumb screw is threaded into the female member to engage the rod, locking it in place. The rod has a roof engaging end with a point to slightly embed itself in the roof. The adjustable rod has a plurality of drilled holes for receiving the thumb screw, making a positive locking arrangement to avoid any slipping of the rod. Dierolf, U.S. Pat. No. 5,119,904 discloses a means and method which provide for walking on residential and commercial tile roofs with minimal breakage of the tile. A support provided which has a planar backboard of plywood or the like with a pair of spaced, soft resilient parallel cushions on the front surface which are laid down into the troughs of the tile roof to distribute weight, and to distribute the weight particularly into the troughs of the roof, which are supported underneath by the sub-roof. The supports are distributed in a pathway over the roof to get the workman to the point on the roof that he needs to access, without stepping directly on the tiles. Monaco U.S. Pat. No. 5,249,397 discloses a knockdown roof platform for use on an inclined roof comprising a table structure and an upper flat table top. The table structure has a hollowed area on its underside. Struts are formed integral inside the hollowed area on an underside of the upper flat table top. An upright leg structure is positioned at one end of the table structure having an upper flat table surface positioned in a common plane with the upper flat table top.

A hinge connects the table structure and the upright leg structure in assembly together. Collapsible locking brackets further secure the table structure and the upright leg structure in assembly. The collapsible locking brackets are being adjustable to secure the table structure and the upright leg structure in right angular relation thereby positioning the upper flat table top coplanar with the upper flat table top on the table structure. The collapsible locking bracket is releasable enabling the table structure and the upright leg structure to be pivoted on the hinge thus moving and collapsing the table structure and the upright leg structure out of right angular relation relative to one another and into a storage position where the table structure and the upright leg structure extend almost in parallel relation.

The above prior art does not provide a roof-top stair-step system whereby each step engages with the next. The prior art also does not teach a base frame which slides underneath a given tile, engaging the tile below, resulting in the base frame resting on the sub-roof and preventing the frame from sliding off the roof. The present invention fulfills these needs and provides further related advantages as described in the following summary.

SUMMARY OF THE INVENTION

The present invention is an improved roof-top stair step assembly. A set of individual steps is constructed of structural materials for supporting the weight of workmen and their materials and tools on a peaked roof. Each of the steps has a horizontal platform which is strong enough to step and walk upon. The platform is supported by a support frame which sits upon the roof on rest means. A first type of the rest means is positioned directly under the platform and is primarily used to transfer the platform's weight to the roof surface. A second type of the rest means extends inwardly toward the roof and rests upon it, preferably engaged by a tile so that the assembly cannot slide off the roof. Each additional step fits interlocked with the previous step and rests with the second type of the rest means against the roof and engaged therewith. In this manner, the steps may be set-up to form a staircase for mounting the roof from the eaves to the peak.

Thus, it is an object of the present invention to provide a portable stairs for temporary installation on a peaked roof to enable workmen to mount the roof safely. It is another object of the present invention to provide such a stairs made-up from a set of portable steps. It is another object of the invention that the steps are easily interlocked with the roof and with each other, when mounted in place on the roof. It is a final object of the invention to provide such a set of steps constructed so that a supporting frame of the invention cannot break roof tiles supporting the frame.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for staging and for enabling safe movements by workmen on a peaked roof. In such drawings.

DETAILED DESCRIPTION OF THE PREFERRED EMBODIMENT

Figure 1:
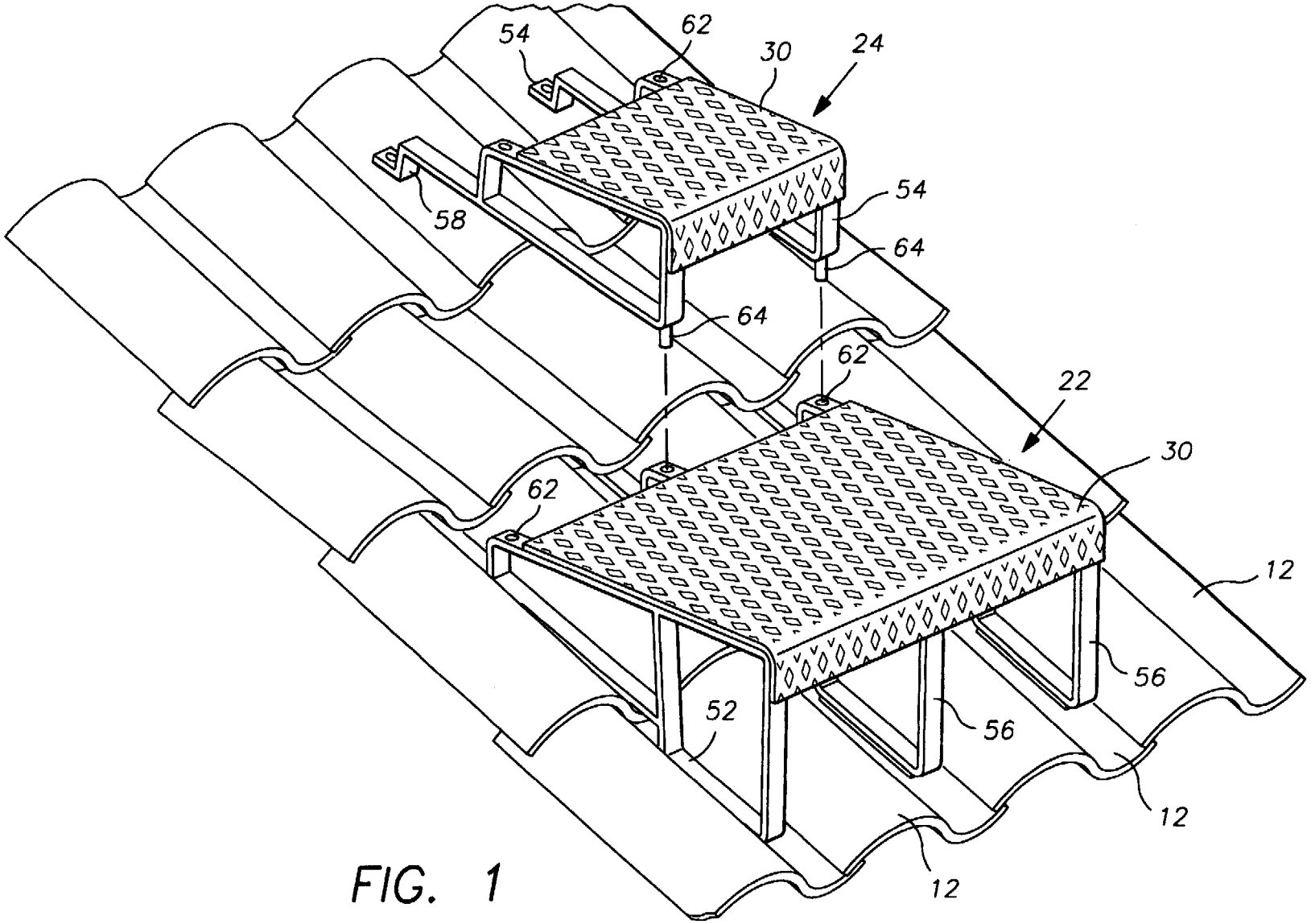
FIG. 1 is a perspective view of the preferred embodiment of the present invention, particularly showing a first roof step in place on a tile roof, and a second roof step positioned above the first step in a position for insertion into the first step.
Figure 2:
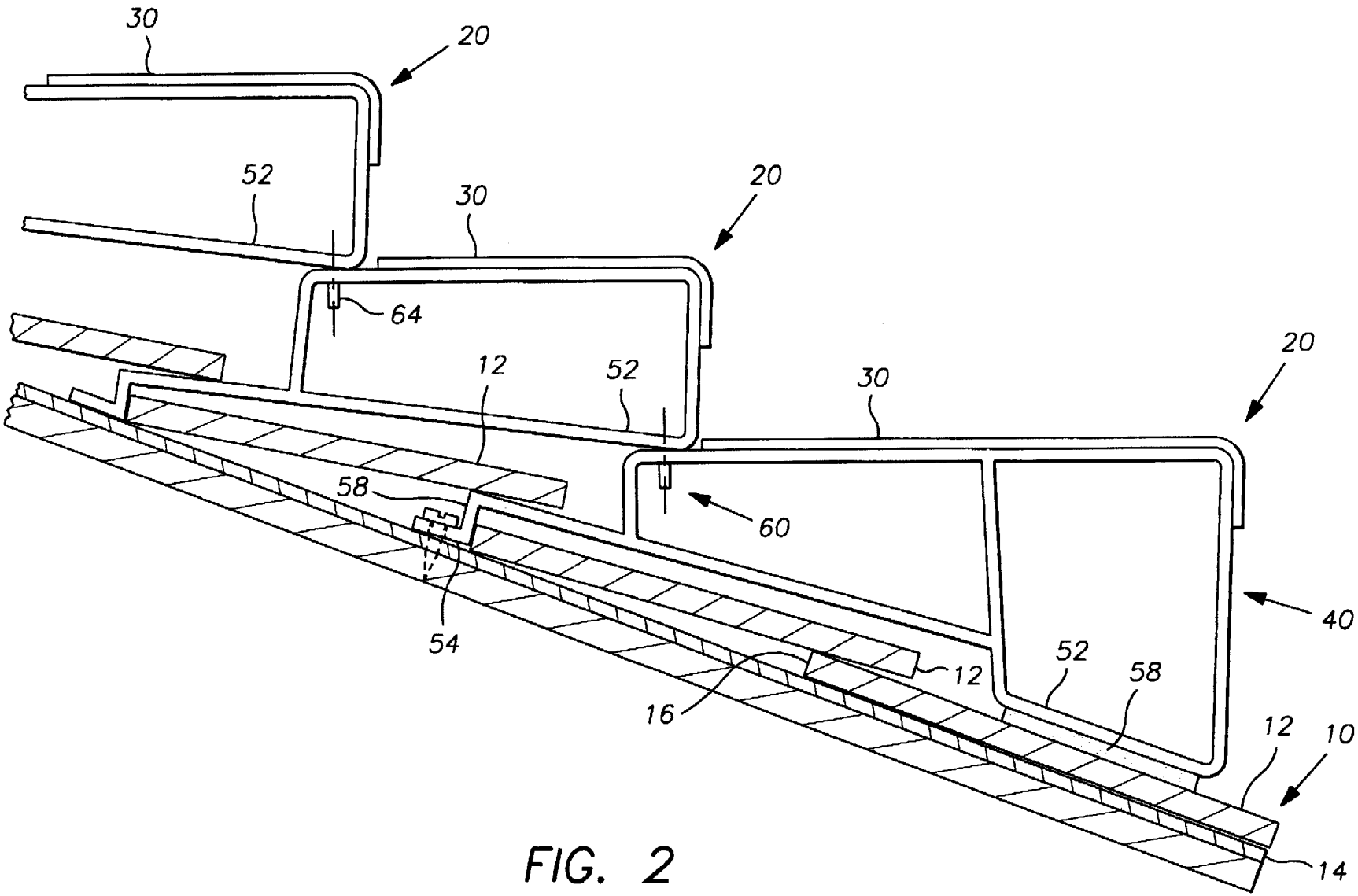
FIG. 2 is a side elevational view thereof showing three steps assembled into a stair case, and further showing the preferred manner in which the steps are engaged with the tiles of a roof.

The above described drawing figures illustrate a portable stair step apparatus for use on a peaked roof 10. The apparatus generally includes a plurality of steps 20. Each of the steps 20 includes a horizontal platform 30, fixed to and supported by a frame 40 extending downwardly from it. The frame 40 terminates with a rest means angled for flush contact with the roof 10. By this is meant that the rest means is in flush contact with the roof 10, so that it forms an acute angle with the platform 30 which is preferably horizontal. The frame 40 further provides mutual engagement means 60 for interconnecting one of the steps 20 with the next to form a staircase on one side of the peaked roof 10. The mutual engagement means 60 on one of the steps includes at least two horizontally oriented holes 62, while the mutual engagement means on other steps 20 comprises at least two vertically oriented pins 64 as well as the holes 62. The holes 62 on any of the steps 20 receives the pins 64 of any one of the one other of the steps 20. The step 20 with no pins 64 is used as a base or first step 22. It is positioned adjacent to the eaves, or edge, of the roof 10. A second step 24 engages its pins 64 into the holes 62 of the first step 22 so as to lock these two steps 20 together. The second step 24 is positioned adjacent to the first step 22 in a direction away from the eaves. Each further step 20 is likewise attached to a previous step 20 so that a stair case is formed moving up the side of the roof.

The rest means comprises a first rest portion 52 positioned under the platform 30, and a second rest portion 54 positioned laterally with respect to the platform 30 and at a higher elevation than the first rest portion 52 whereby the first rest portion 52 rests on a lower portion of the roof 10 than the second rest portion 52. The rest means is preferably comprised of a plurality of spaced apart legs 56, each of the legs 56 including the first and second rest portions 52, 54. Preferably the spaced apart legs 56 cooperate with a spacing of a line of roof tiles 12. These roof tiles 12 can generally transmit a compressive load, but tend to shatter under a bending load. Curved tiles 12 are generally laid on the roof 10 such that portions of these tiles 12 are in contact with a sub-roof 14 portion of the roof 10, while other portions of the tiles 12 are above the level of the sub-roof 14 due to the tile's curvature. A row of tiles 12 will have the portions of the tiles 12 which are in contact with the roof 10, spaced on a fixed periodic basis. The legs 56 of the frame 40 of the invention, also, are spaced apart so as to match the periodic spacing of the tiles 12, so that the rest means only contact with that portion of the tiles 12 that, in turn, is directly supported by the sub-roof 14. In this manner the weight of the step 20 and its load is transferred to the sub-roof 14 without causing the tiles to shatter.

The second rest portion 54 includes a vertical leg portion 58 positioned for contacting an edge 16 of a roof tile 12 so as to prevent the apparatus from slipping downwardly on the roof 10. The second rest portion 54 preferably extends laterally to one side of the platform so that the first and second rest portions 52, 54 span at least one of the roof tiles 12. Since the second rest portion 54 contacts only the sub-roof 14, much of the weight of the load is not transferred through the tiles, but rather, directly to the sub-roof, so that the tiles 12 are less likely to be fractured or bent. Preferably, the first rest portion 52 provides a cushion strip 58 attached to it and laying between the frame 40 and the tiles 12. This helps to spread the load of the apparatus in a more uniform manner. Additionally, the second rest portion 54 may include a means for attachment to the sub-roof 57, such as a screw fastener or any other common fastener for attachment to a wooden roof member. The invention is preferably made with the base step wider than other steps. This is so such that the base step 20 may be used as a materials staging area, while the other steps 20 are used for passage, up and down the roof 10. Also, the base step 20 is preferably constructed to span a greater distance between the first 52 and second 54 rest portions of the rest means, again, to give the platform 30 of the base step 20 a greater surface area.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination portable step apparatus and a peaked roof, comprising:

a plurality of roof tiles laid on the peaked roof in overlapping rows;

a plurality of roof steps, each of the steps providing a horizontal platform, fixed to and supported by a frame extending downwardly therefrom, and terminating with a rest means angled for flush contact with the roof, and further providing mutual engagement means for connecting one of the steps with the next to form a staircase on one side of the peaked roof, the mutual engagement means on one of the steps comprising at least two horizontally oriented holes, the mutual engagement means on at least one other of the steps comprising at least two vertically oriented pins and at least two of the horizontally oriented holes, the holes on any of the steps receiving the pins of any one of the one other of the steps the rest means comprising a first rest portion positioned under the platform, and a second rest portion positioned lateral to the platform and at a higher elevation than the first rest portion, the first rest portion and the second rest portion being spaced apart so as to enable at least one of the roof tiles to be positionable therebetween so that a vertical leg portion of the second rest portion is in contact with an edge of one of the roof tiles thereby preventing the apparatus from moving downwardly on the roof, the roof steps being removably engagable to establish a stair step arrangement for walking up and down on the peaked roof.

* * * * *